US006966293B1

(12) United States Patent
Patillo

(10) Patent No.: US 6,966,293 B1
(45) Date of Patent: Nov. 22, 2005

(54) FAN INDUCTION BLOWER BOX

(76) Inventor: Kevin Patillo, 35 S. St. Clair St., Loft 223, Dayton, OH (US) 45402

( * ) Notice: Subject to any disclaimer, the term of this patent is extended or adjusted under 35 U.S.C. 154(b) by 0 days.

(21) Appl. No.: 10/921,708

(22) Filed: Aug. 19, 2004

(51) Int. Cl.[7] ..... F02B 77/00; B01D 19/00
(52) U.S. Cl. ..... 123/198 E; 123/559.1; 55/383; 55/385.3; 180/68.3
(58) Field of Search ..... 123/198 E, 565, 123/559.1; 55/383, 385.3; 180/68.3

(56) References Cited

U.S. PATENT DOCUMENTS 4,453,524 A * 6/1984 Lee ..... 123/565
4,533,012 A * 8/1985 Komoda ..... 180/68.3
5,632,793 A * 5/1997 Haggard ..... 55/498
6,328,024 B1 * 12/2001 Kibort ..... 123/565

FOREIGN PATENT DOCUMENTS

EP 0312107 A1 * 4/1989 ..... F02B 39/10
JP 59188028 A * 10/1984 ..... F02B 29/00

* cited by examiner

*Primary Examiner*—Noah P. Kamen
(74) *Attorney, Agent, or Firm*—R. William Graham

(57) ABSTRACT

An improvement in an air filter compartment of an internal combustion engine within a vehicle includes an air filter compartment having a forward end having an air inlet connected to the vehicle to receive air through a front grill of the vehicle and a rear end with an air outlet leading to an engine intake of the vehicle. The air filter compartment has an intermediate portion configured to removably retain an air filter adjacent the forward end and a high output fan rearwardly of the air filter. The fan operably connects to a power supply of the vehicle.

5 Claims, 2 Drawing Sheets

FAN INDUCTION BLOWER BOX

BACKGROUND OF THE INVENTION (1) Field of the Invention

This invention relates to enhancing fuel efficiency and performance in an internal combustion engine.

(2) Description of the Prior Art

Vehicles are typically powered by internal combustion engines. Increasing gas costs have once again triggered a concern with maximizing fuel efficiency as well as performance.

There exist a significant number of devices for increasing gas mileage of the combustion engine. It is prior art to increase the volume of an air induction charge in an internal combustion engine by providing a compressed air supply to the engine rather than induction directly from the atmosphere. Where the engine is provided with combustible fuel via a carburetor/fuel injection mixing the fuel with the induction air volume, the carburetor includes a fuel reservoir which supplies fuel to the carburetor jets/fuel injection.

The fuel reservoir is maintained at atmospheric pressure so that the carburetor/fuel injection may proportion the fuel air mixture by virtue of the static pressure difference at the carburetor venture/fuel injection compared with the fuel reservoir. Carburetor/fuel injection supercharged induction systems (including turbochargers) traditionally placed the carburetor/fuel injection at the atmospheric end before the air compressor. Other systems place the turbo charger compressor before the carburetor in the induction system. These attempts to increase the performance of engines have met with some success. Also, different methods for controlling the amount of air to fuel mixture have been tried.

While there has been a significant amount of advancements in the art, there remains a need to improve on such systems as applied to a vehicle. The present invention provides an alternative fan induction blower box system which is useful in this regard.

SUMMARY OF THE INVENTION

An object of this invention is to improve fuel efficiency in an internal combustion engine.

Another object is to provide increased air flow to the intake of an internal combustion engine.

Still another object to increase power using a high output fan within an air filter compartment leading to the intake of an internal combustion engine.

A further object is to provide a retro fit air filter high output fan device which can boost fuel efficiency and power in existing vehicles in a relatively inexpensive and easy way.

The present invention is therefore directed to an improvement in an air filter compartment of an internal combustion engine within a vehicle. The improvement includes an air filter compartment having a forward end having an air inlet connected to the vehicle to receive air through a front grill of the vehicle and a rear end with an air outlet leading to an engine intake of the vehicle. The air filter compartment has an intermediate portion configured to removably retain an air filter adjacent the forward end and a high output fan rearwardly of the air filter. The fan operably connects to a power supply of the vehicle.

Other objects and advantages will be clear from the following description and from the accompanying drawing.

DESCRIPTION OF THE PREFERRED EMBODIMENT

Figure 1:
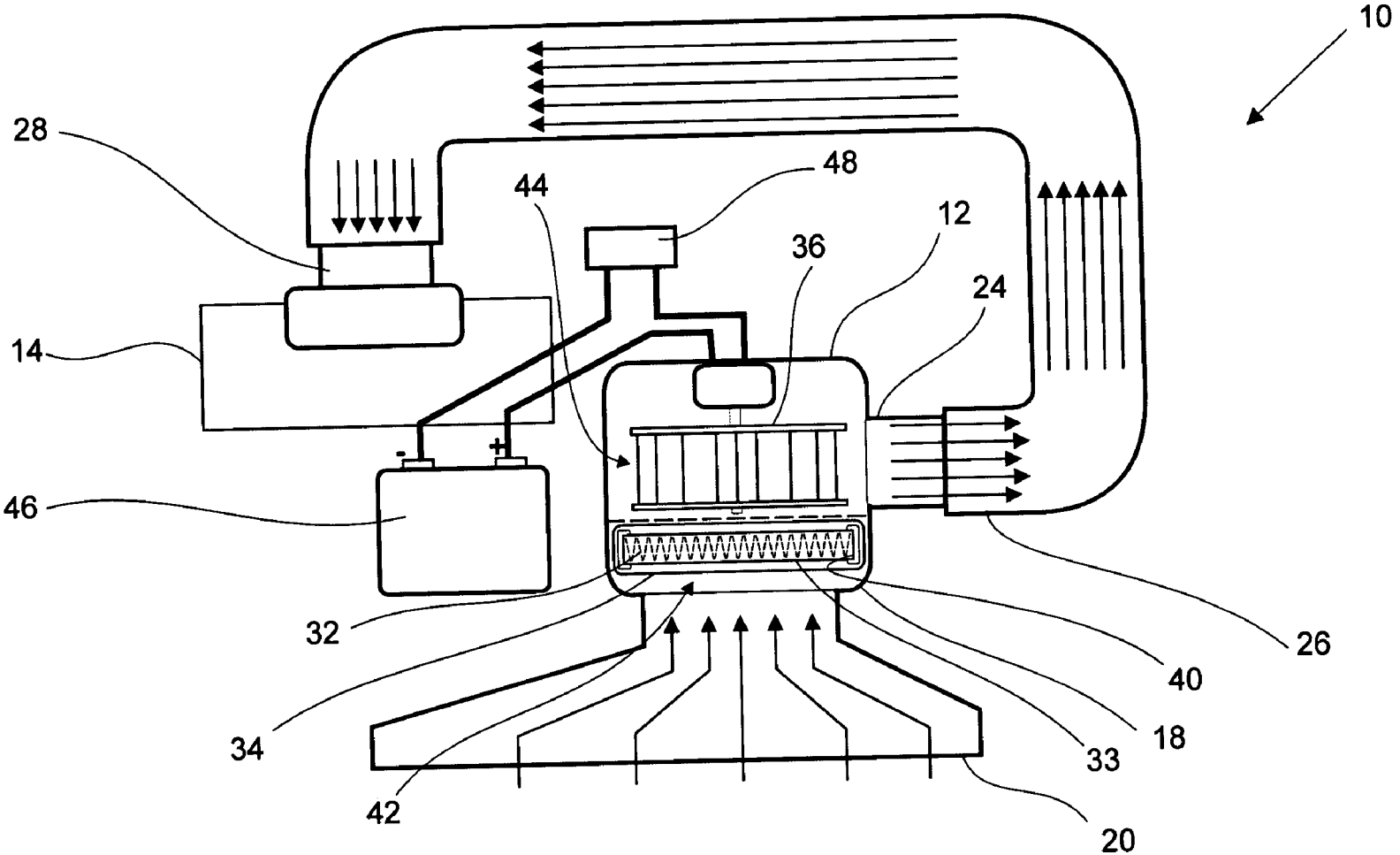
FIG. 1 is a schematic representation showing the invention within a vehicle.
Figure 2:
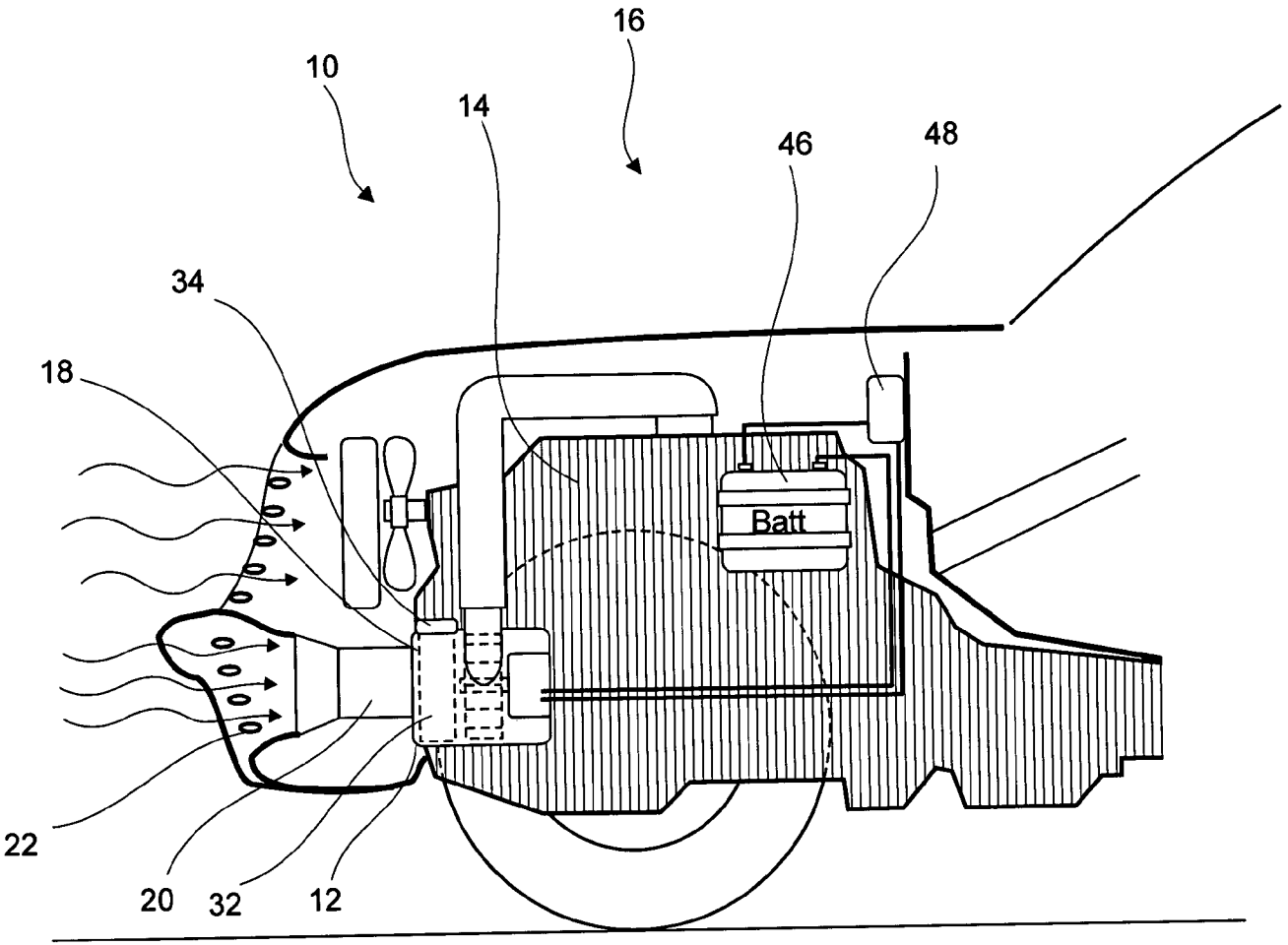
FIG. 2 is a side perspective view of the invention within a vehicle.

Referring now to the drawings, the fan induction blower box of the present invention is generally represented by the number 10. The fan induction blower box 10 includes a modified air filter compartment 12 of an internal combustion engine 14 within a vehicle 16. The improvement includes modified air filter compartment 12 having a forward end 18 having an air inlet 20 connected to the vehicle 16 to receive air through a front grill 22 of the vehicle 16.

A rear end 24 of the compartment 12 includes an air outlet 26 leading to an engine intake 28 of the vehicle engine 14. The air filter compartment 12 has an intermediate portion 30 configured to removably retain an air filter 32 with a lid 34 adjacent the forward end 18 in an intermediate portion 38.

A high output fan 36 is rearwardly disposed of the air filter 32 within the compartment 12 adjacent the rear end 24. A grooved surface 40 can be formed in compartment 12 to retain the air filter 32 wherein the air filter 32 can include a relatively rigid outer frame configured to seat within the grooved surface 40 and includes a filter material of a type known in the art which can be retained by the frame 33 which together cover a cross-sectional area within the intermediate portion 38 thereby separating the compartment 12 into an unfiltered zone 42 and filtered zone 44.

The high output fan 36 is operably connected to a power supply, such as battery 46, of the vehicle 16. A computer 48 can be provided in a manner to operably interconnect to the battery 46 and the fan 36 such that the fan 36 can be controlled in accordance with predetermined conditions of which can be monitored and controlled by the computer 48. Such conditions can include sensed outside temperature, vehicle power requirements, and fuel throttle position, for example. The high output fan 36 draws air transversely through the air filter 32 and delivers it at a pressure indicated by the computer 48 to the outlet 26 which directs the air to the carburetor/fuel injection intake 28. Optionally, the computer 48 can be equipped with a switch to manually activate/deactivate the operation thereof as well as the fan 36.

An advantage of the instant invention is that it can be readily adapted to work in virtually any vehicle with minimal change required to current air filter compartment of a conventional standard engine, wherein the carburetor intake can be a conventional unit. Further, the high fan output unit and exhaust system are positioned to give good access to cycle components and to maintain the lowest possible centre of gravity without necessitating a long and complicated air induction passage the re-routing of carburetor controls, or the repositioning of major cycle components.

The above described embodiment is set forth by way of example and is not for the purpose of limiting the present invention. It will be readily apparent to those skilled in the art that obvious modifications, derivations and variations can be made to the embodiment without departing from the scope of the invention. Accordingly, the claims appended hereto should be afforded such scope.

What is claimed is:

1. An improvement in an air filter compartment of an internal combustion engine within a vehicle, wherein the improvement includes an air filter compartment having a forward end having an air inlet connected to the vehicle to receive air through a front grill of the vehicle and a rear end with an air outlet leading to an engine intake pipe of the vehicle, said air filter compartment having an intermediate portion, an air filter is disposed in said intermediate portion, wherein said intermediate portion is configured to removably retain said air filter adjacent said forward end, and a high output fan disposed rearwardly of said air filter in said compartment wherein said high output fan operably connects to a power supply of the vehicle.

2. The improvement in an air filter compartment of an internal combustion engine within a vehicle of claim 1, wherein said intermediate portion includes an internal grooved surface forming a seat to receive said air filter, such that when so seated said air filter substantially extends across a cross-sectional area of within said compartment to provide a filtered zone and an unfiltered zone.

3. The improvement in an air filter compartment of an internal combustion engine within a vehicle of claim 1, which further includes a computer operably connected to said fan and said power source to control operation of said fan in accordance with a predetermined condition including one of temperature, vehicle power requirements and throttle position.

4. The improvement in an air filter compartment of an internal combustion engine within a vehicle of claim 1, wherein said computer includes a switch to manually activate/deactivate operation thereof and said fan.

5. The improvement in an air filter compartment of an internal combustion engine within a vehicle of claim 1, wherein said compartment is located adjacent said front grill.

* * * * *